US006560903B1

(12) United States Patent
Darley

(10) Patent No.: US 6,560,903 B1
(45) Date of Patent: May 13, 2003

(54) AMBULATORY FOOT POD

(75) Inventor: Jesse Darley, Watertown, MA (US)

(73) Assignee: Personal Electronic Devices, Inc., Southborough, MA (US)

( * ) Notice: Subject to any disclaimer, the term of this patent is extended or adjusted under 35 U.S.C. 154(b) by 0 days.

(21) Appl. No.: 09/521,073

(22) Filed: Mar. 7, 2000

(51) Int. Cl.[7] ..... A43B 23/00

(52) U.S. Cl. ..... 36/136; 36/50.1; 36/51; 24/712.2; 377/24.2

(58) Field of Search ..... 36/136, 132, 1, 36/50.1, 51; 377/24.2, 23; 40/636; 224/182; 24/712.1, 712.3, 712.2, 712, 712.8

(56) References Cited

U.S. PATENT DOCUMENTS

| | | | | | |
|---|---|---|---|---|---|
| 2,233,544 | A | * | 3/1941 | McKinley | 359/519 |
| 2,268,644 | A | * | 1/1942 | Dahlberg | 24/712.2 |
| 3,699,672 | A | * | 10/1972 | Sims | 15/227 |
| 3,974,491 | A | | 8/1976 | Sipe | |
| 4,120,052 | A | * | 10/1978 | Butler | 2/16 |
| 4,402,147 | A | | 9/1983 | Wu | |
| 4,466,204 | A | * | 8/1984 | Wu | 36/136 |
| 4,485,529 | A | * | 12/1984 | Blum | 24/128 |
| 4,510,704 | A | | 4/1985 | Johnson | |
| 4,536,975 | A | * | 8/1985 | Harrell | 36/136 |
| 4,578,769 | A | | 3/1986 | Frederick | |
| 4,597,198 | A | * | 7/1986 | Schweitzer | 2/245 |
| 4,649,552 | A | | 3/1987 | Yakawa | |
| 4,651,446 | A | | 3/1987 | Yukawa et al. | |
| 4,745,564 | A | | 5/1988 | Tennes et al. | |
| 4,771,394 | A | | 9/1988 | Cavanagh | |
| 4,814,661 | A | | 3/1989 | Ratzlaff et al. | |
| 4,817,306 | A | | 4/1989 | Bayer | |
| 4,823,426 | A | * | 4/1989 | Bragga | 15/210.1 |
| 4,897,947 | A | | 2/1990 | Kass-Pious | |
| 4,932,914 | A | | 6/1990 | Aranda | |
| 5,033,013 | A | | 7/1991 | Kato et al. | |
| 5,063,690 | A | | 11/1991 | Slenker | |
| 5,269,081 | A | | 12/1993 | Gray | |
| 5,285,586 | A | | 2/1994 | Goldston et al. | |
| 5,311,679 | A | | 5/1994 | Birch, Sr. | |
| 5,313,719 | A | | 5/1994 | Koethe | |
| 5,323,650 | A | | 6/1994 | Fullen et al. | |
| 5,343,445 | A | | 8/1994 | Cherdak | |
| 5,357,696 | A | | 10/1994 | Gray et al. | |
| 5,361,778 | A | | 11/1994 | Seitz | |
| 5,437,289 | A | | 8/1995 | Liverance et al. | |
| 5,485,402 | A | | 1/1996 | Smith et al. | |
| 5,502,903 | A | | 4/1996 | Barker | |
| 5,539,706 | A | | 7/1996 | Takenaka et al. | |
| 5,566,477 | A | | 10/1996 | Mathis et al. | |
| 5,596,821 | A | | 1/1997 | Solo | |
| 5,636,146 | A | | 6/1997 | Flentov et al. | |

(List continued on next page.)

*Primary Examiner*—M. D. Patterson
*Assistant Examiner*—Jila M. Mohandesi
(74) *Attorney, Agent, or Firm*—Wolf, Greenfield & Sacks, P.C.

(57) ABSTRACT

An apparatus to be secured to a person or an article of clothing includes a housing, at least one retaining member, and an elastic member. The housing is adapted to house at least one item. The at least one retaining member is supported by the housing. The elastic member is releasably engageable with the at least one retaining member and is adapted to stretchably encompass at least a portion of the person or article of clothing and to secure the housing to the person or article of clothing when engaged with the at least one retaining member. A method for securing a housing to a person or an article of clothing involves providing a housing and an elastic member, the housing having at least one retaining member supported thereby. The elastic member is wrapped about at least a portion of the person or article of clothing and is stretched. At least a first portion of the elastic member is releasably engaged with the at least one retaining member so that tension remains in the elastic member, thereby securing the housing to the person or article of clothing.

45 Claims, 2 Drawing Sheets

U.S. PATENT DOCUMENTS 5,664,346 A 9/1997 Barker
5,673,501 A 10/1997 Mathews
5,720,200 A 2/1998 Anderson et al.
5,724,265 A 3/1998 Hutchings
5,728,032 A 3/1998 Glass
5,775,011 A 7/1998 Reitano, Jr.
5,921,008 A * 7/1999 Ruff ..... 36/136
5,930,920 A 8/1999 Arnold
5,955,667 A 9/1999 Fyfe
6,094,844 A 8/2000 Potts
6,122,340 A * 9/2000 Darley et al. ..... 377/24.2

* cited by examiner

AMBULATORY FOOT POD

FIELD OF THE INVENTION

The present invention is directed to a novel apparatus and technique for mounting a housing to a person or an article of clothing.

BACKGROUND OF THE INVENTION

There are numerous situations wherein it is desirable to mount a housing (adapted to house on or more items) to a person or an article of clothing. For example, it may be desirable for a person in locomotion on foot (e.g., walking, jogging, or running) to carry one or more items with him/her for various reasons. Items a person may desire to carry may include, for example, personal effects (such as money, identification, public transportation passes, etc.), electronic devices (such as a watch, a pedometer, a heart-rate monitor, etc.), or any other item(s) of a size suitable to be carried by the person.

One known device that employs a housing secured to a person is a wristwatch. With a typical wristwatch, the housing is secured to a person's wrist using a strap having two separate pieces. One end of each of the strap pieces is connected to the housing, and the other ends of the strap pieces are connected together by a clasp or the like after both strap pieces have been draped around the circumference of the person wrist. Alternatively, both ends of a one-piece elastic band may be connected to the housing so that the elastic band can simply be stretched open and extended over the persons hand onto the person's wrist.

It is also known to secure a housing to a person's shoe. For example, a nylon pouch can be secured to a shoelace of a person's shoe using a strap having hook and loop fasteners disposed thereon. Such a device is commonly referred to as a "foot pouch" or "foot wallet." Yet another technique for securing a housing to a person's shoe is disclosed in co-pending patent application Ser. No. 09/164,654, filed on Oct. 1, 1998, wherein a housing (having a motion sensor disposed therein) is releasably mated with a separate mounting unit disposed on the person's shoe. The entire contents of application Ser. No. 09/164,654 are hereby incorporated herein by reference.

The present invention is directed to a new and useful apparatus and technique for securing a housing (adapted to house one or more items) to a person or an article of clothing.

SUMMARY OF THE INVENTION

According to one aspect of the present invention, an apparatus to be secured to a person or an article of clothing includes a housing, at least one retaining member, and an elastic member. The housing is adapted to house at least one item. The at least one retaining member is supported by the housing. The elastic member is releasably engageable with the at least one retaining member and is adapted to stretchably encompass at least a portion of the person or article of clothing and to secure the housing to the person or article of clothing when engaged with the at least one retaining member.

According to another aspect of the invention, a method for securing a housing to a person or an article of clothing involves providing a housing and an elastic member, the housing having at least one retaining member supported thereby. The elastic member is wrapped about at least a portion of the person or article of clothing and is stretched. At least a first portion of the elastic member is releasably engaged with the at least one retaining member so that tension remains in the elastic member, thereby securing the housing to the person or article of clothing.

DETAILED DESCRIPTION

According to one aspect of the present invention, a novel technique for securing a housing to a person or an article of clothing is disclosed which employs an elastic strap that can be releasably engaged with one or more retaining members disposed on the housing. In one embodiment, the elastic strap may be inserted underneath a person's shoelace crossings and stretched. When the elastic member is in its stretched state it may be engaged with one or more retaining members on the housing so that the housing is firmly secured to the shoe because of the tension in the elastic member.

Figure 1A:
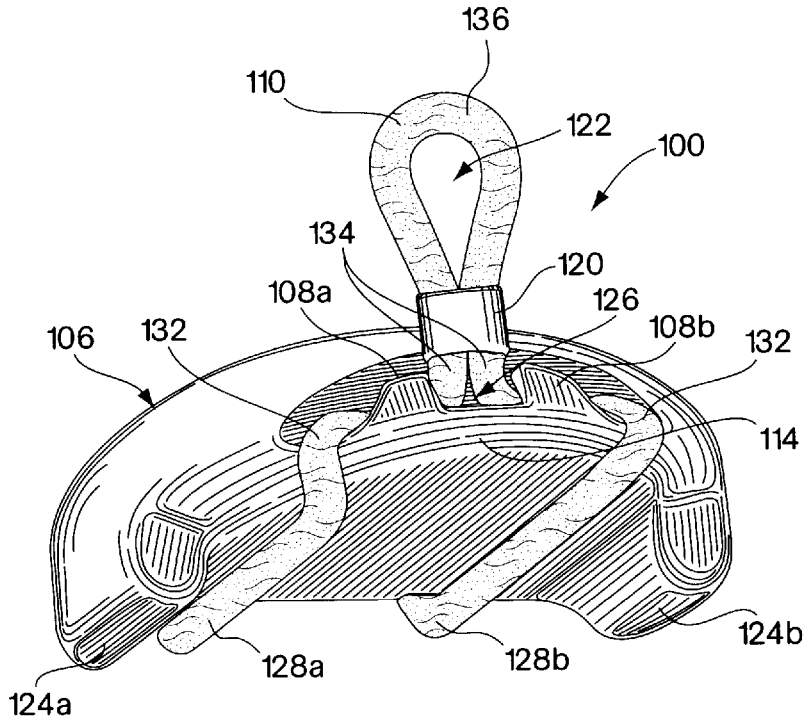
FIGS. 1A–B show perspective views of the front and back, respectively, of an illustrative embodiment of an apparatus according to the invention.
Figure 1B:
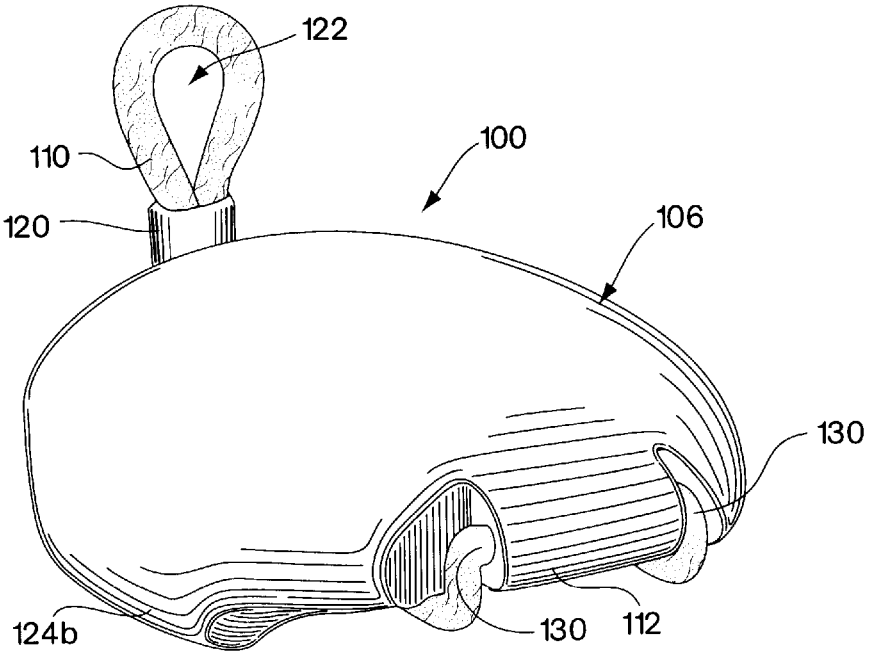
Figure 2:
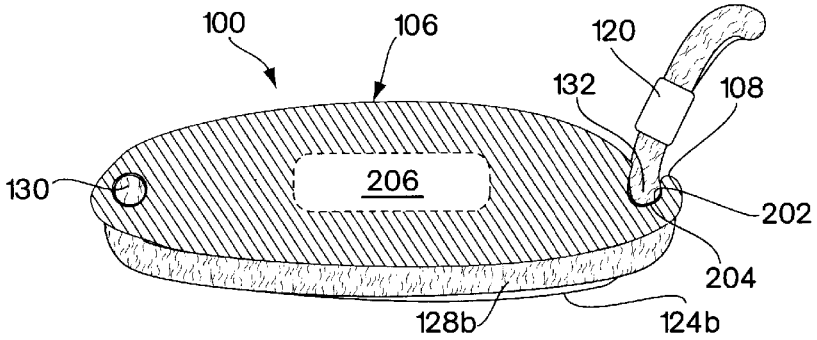
FIG. 2 shows a partial cut-away, side view of the embodiment of FIGS. 1A–B.
Figure 3:
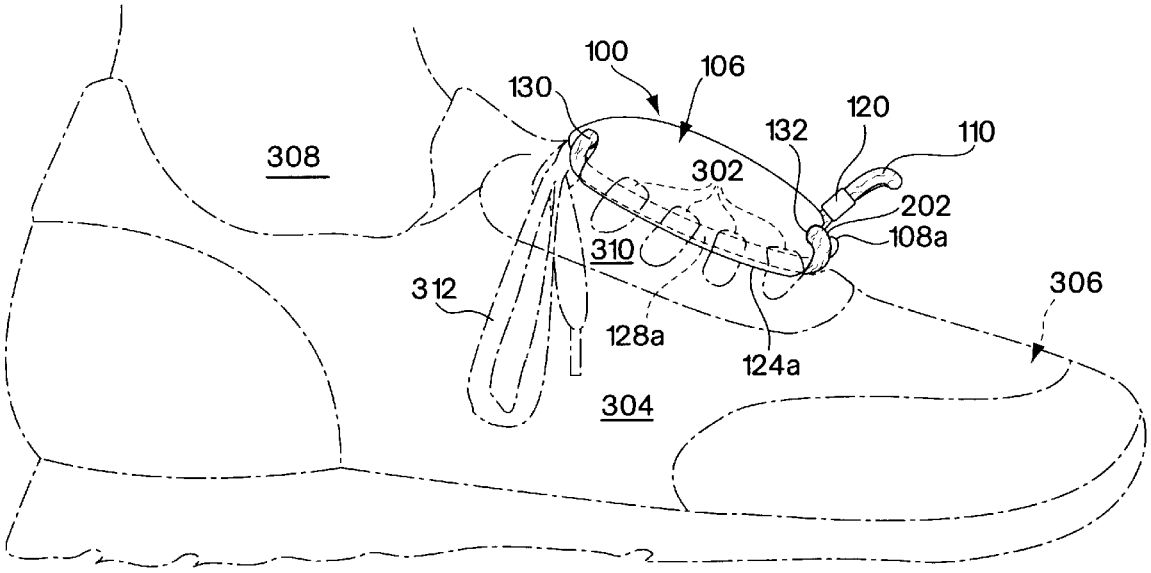
FIG. 3 illustrates how the embodiment of FIGS. 1A–B and 2 may be mounted on the shoe of a person.

An example embodiment of the present invention is shown in FIGS. 1–3. FIGS. 1A–B show perspective views of the front and back, respectively, of an embodiment of an apparatus according to the invention; FIG. 2 shows a partial cut-away, side view of the embodiment of FIGS. 1A–B; and FIG. 3 shows an example of how the embodiment of FIGS. 1A–B and 2 may be mounted on the shoe of a person.

At the outset, it should be appreciated that FIGS. 1–3 illustrate only one of a number of possible embodiments of the present invention, and that the invention is not limited to the particular embodiment shown. For example, alternative embodiments of the invention may be adapted to be secured to other portions of a person's body (e.g., a person's wrist, ankle, neck, head, or torso) or may be adapted to be secured to articles of clothing other than a shoe (e.g., a belt, a belt loop, a pant leg, a shirt sleeve, a hat, etc.).

As shown in FIGS. 1–3, an apparatus 100 according to the invention may include a housing 106 capable of carrying one or more items therein. The housing 106 may be constructed in any of numerous ways using any of a number of materials, and the invention is not limited to a housing of any particular type or shape. In one embodiment, the housing 106 is made of semi-rigid polyethylene material so that the contents thereof will not be damaged by minor impact forces exerted on the outside of the housing 106. In addition, in one embodiment, the housing 106 may be self-contained and water-tight so that it may be exposed to adverse whether conditions (e.g., rain, sleet, or snow) without damage to its contents. As illustrated best in FIGS. 1A–B, the housing 106 may include a pair of wings 124*a–b* which are shaped to the contour of an instep 310 of a shoe 304 (see FIG. 3) so as to enhance the stability of the housing 106 atop the shoe 304.

The housing 106 may be constructed to house any of a number of items, and the invention is not limited a housing for any particular type of item. In one illustrative embodiment, for example, the housing 106 is constructed to house a sensor 206 (see FIG. 2) for sensing motion of a foot 306 of a person 308 (see FIG. 3) when the apparatus 100 is mounted on the shoe 304 of the person 308. An example of a sensor 206 and associated circuitry that may be disposed within the housing 106 is disclosed in co-pending patent application Ser. No. 08/942,802, which is hereby incorporated herein by reference.

As shown, the housing 106 may have a retaining member 108 disposed thereon. The retaining member 108 may take on any of numerous forms, and the invention is not limited to a retaining member of any particular type or shape. It is important only that the retaining member 108 be capable of receiving an elastic member 110 (or an extension thereof such as a hook or ring) after the elastic member 110 has been stretched about the portion of the object to which the apparatus 100 is to be secured (e.g., crossings 302 of a shoelace 312 of the shoe 304). In the example shown, the retaining member 108 forms a shoulder 202 (see FIG. 2) on which a portion 204 of the elastic member 110 can be retained when the elastic member 110 is stretched about the shoelace crossings 302.

The retaining member 108 may be disposed on the housing 106 in any of a number of ways, and the invention is not limited to a retaining member 108 formed in any particular manner. In the illustrative embodiment shown, for example, the retaining member 108 is an integrally-formed extension of the housing 106 (i.e., the two components are formed from the same mold). In the alternative embodiments, the retaining member 108 may first be formed separately from the housing 106, and then may be secured to the housing 106 using a fastener, an adhesive (e.g., an epoxy), laser welding, or any other known device or technique.

The elastic member 110 employed in connection with the invention may be made of any of a number of materials and may take on any of numerous forms. The invention is not limited to an elastic member 110 of any particular type or shape. It is important only that the elastic member 110 have a sufficient degree of elasticity that at least some tension remains in the elastic member 110 when the elastic member is wrapped about the object to which the housing 106 is secured. Because of this property, the elastic member can firmly retain the housing 106 to the object to which it is secured even when the object changes shape slightly, for example, when the instep 310 of the shoe 304 flexes slightly during a footstep taken by the person 308. The elastic member 110 may, for example, be an elastic shock cord such as the type used for hair braids, a rubber stretch cord, or any other cord or element made of a material having the desired characteristics.

In the embodiment shown, the elastic member 110 is in the form of a closed loop so that two distinct portions 128*a* and 128*b* of the elastic member 110 can each be wrapped about the crossings 302 of the shoelace 312.

As shown best in FIG. 1B, one portion 130 of the elastic member 110 may be non-releasably secured to a back portion 112 of the housing 106, and another portion 132 of the elastic member 110 may be releasably engageable with the retaining member 108, which is disposed on a front portion 114 of the housing 106. Therefore, in this embodiment, an end 136 of the elastic member 110 (adjacent the portion 132) may be inserted, for example, underneath the crossings 302 of the shoelace 312 (see FIG. 3), and the elastic member 110 may then be stretched and placed over the retaining member 108 so that it contacts and is held in place by the shoulder 202 thereof. In this manner, the tension in the elastic member 110 can serve to hold the housing 106 firmly in place on the instep 310 of the shoe 304.

As shown best in FIG. 1A, a sleeve 120 may be disposed adjacent the end 136 of the elastic member 110 so that the length of the portions 128*a–b* of elastic member 110 (i.e., the sections of the elastic member 110 that are used to secure the housing 106 to an object) may be adjusted by sliding the sleeve 120 along a looped portion of the end 136 of the elastic member 110. The loop 122 formed in this manner is also useful because it provides a defined portion of the elastic member 110 that the user may grasp when stretching the elastic member 110 before engaging it with the retaining member 108.

As shown in FIG. 1A, the retaining member 108 may include two separate portions 108*a* and 108*b* with a gap 126 formed therebetween. The gap 126 may provide a space in which a section 134 of the elastic member 110 can rest and be held in place when the portion 132 of the elastic member 110 is engaged with the retaining member 108. By holding the section 134 of the elastic member 110 in the same position, this configuration can serve to keep the relative lengths of the portions 128*a* and 128*b* of the elastic member 110 approximately the same. Therefore, this feature further helps to enhance the stability of the apparatus 100 on the instep 310 of the shoe 304.

Figure 4:
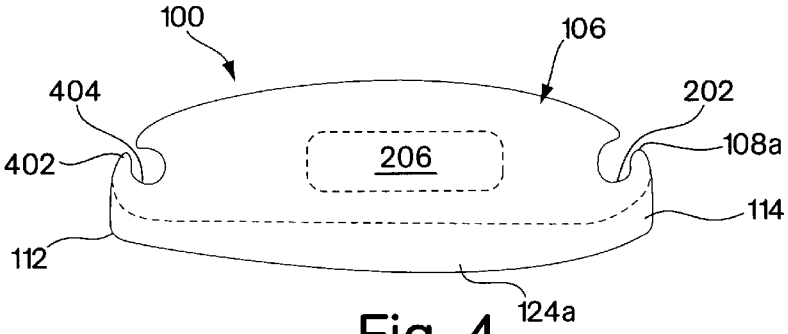
FIG. 4 shows an alternative embodiment of an apparatus according to the invention.

FIG. 4 shows an alternative embodiment of the apparatus 100 wherein separated retaining members 108 and 402 are disposed, respectively, on the front portion 114 and the back portion 112 of the housing 106 so that the elastic member 110 may be removed entirely from the housing 106 when the housing 106 is not secured to the shoe 104. As shown, the retaining member 402 may be shaped similar to the retaining member 108, and may include a shoulder 402 on which the portion 130 of the elastic member may rest and be held in place when the elastic member 110 is stretched and releasably engaged with both the retaining member 108 and the retaining member 402.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A combination, comprising:

a shoe having a shoelace;

a sensor for sensing motion of the shoe;

a housing which houses the sensor;

at least one retaining member disposed on the housing; and an elastic member, distinct from the shoelace, releasably engaged with the at least one retaining member such that the elastic member is in a tensioned state and forms a part of a closed loop that encompasses at least one unknotted crossing of the shoelace, thereby securing the apparatus to the shoelace of the shoe.

2. The combination of claim 1, wherein the at least one retaining member is rigid.

3. The combination of claim 2, wherein the housing is rigid.

4. The combination of claim 1, wherein the housing is rigid.

5. The combination of claim 1, wherein the at least one retaining member includes a pair of retaining members disposed on opposite sides of the housing, and wherein opposite portions of the elastic member are releasably engaged with respective ones of the pair or retaining members to form the closed loop and secure the apparatus to the shoelace of the shoe.

6. The combination of claim 1, further comprising means, disposed on the housing, for non-releasably engaging a portion of the elastic member.

7. The combination of claim 1, wherein the elastic member is releasably engaged with the at least one retaining member such that the elastic member directly contacts the at least one retaining member to form the closed loop.

8. The combination of claim 1, wherein the at least one retaining member is integrally formed with the housing.

9. The combination of claim 1, wherein the at least one retaining member is formed separately from the housing and is attached to the housing.

10. The combination of claim 9, wherein the at least one retaining member is non-releasably attached to the housing.

11. The combination of claim 1, wherein the at least one retaining member is non-releasably disposed on the housing.

12. The combination of claim 1, wherein the closed loop encompasses at least two unknotted crossings of the shoelace.

13. The combination of claim 12, wherein the closed loop encompasses at least three unknotted crossings of the shoelace.

14. A method for securing a housing to a shoelace of a shoe, the method comprising steps of:

(a) providing the housing and an elastic member other than the shoelace of the shoe, the housing supporting a sensor for sensing motion of the shoe and having at least one retaining member disposed thereon; and (b) securing the housing to the shoelace by stretching the elastic member to selectively engage a first portion of the elastic member with the at least one retaining member, thereby forming a closed loop that includes at least a part of the elastic member and encompasses at least one unknotted crossing of the shoelace.

15. The method of claim 14, wherein:

the step (a) includes providing the housing such that the housing has at least one rigid retaining member supported thereby; and the step (b) includes releasably engaging at least the first portion of the elastic member with the at least one rigid retaining member.

16. The method of claim 15, wherein the step (a) includes providing the housing such that the housing is rigid.

17. The method of claim 14, wherein:

the step (a) includes providing the housing such that the housing has a pair of retaining members disposed on opposite sides of the housing; and the step (b) includes engaging a respective portion of the elastic member with each of the pair of retaining members to form the closed loop and secure the housing to the shoelace of the shoe.

18. The method of claim 14, wherein the step (a) includes providing the housing such that the housing has disposed thereon means for non-releasably engaging a second portion of the elastic member.

19. The method of claim 14, wherein the step (b) includes releasably engaging at least the first portion of the elastic member with the at least one retaining member such that the elastic member directly contacts the at least one retaining member.

20. The method of claim 14, wherein the step (b) includes releasably engaging the first portion of the elastic member with the at least one retaining member so that tension remains in the elastic member when the closed loop is formed and the housing is secured to the shoelace.

21. The method of claim 14, further comprising a step of:

(c) attaching the at least one retaining member to the housing.

22. The method of claim 21, wherein the step (c) includes non-releasably attaching the at least one retaining member to the housing.

23. The method of claim 14, wherein the housing is secured to the shoelace so that the closed loop encompasses at least two unknotted crossings of the shoelace.

24. The method of claim 23, wherein the housing is secured to the shoelace so that the closed loop encompasses at least three unknotted crossings of the shoelace.

25. The method of claim 14, further comprising a step of:

(c) removing the housing from the shoelace without untying the shoelace.

26. A combination, comprising:

a shoe having a shoelace;

a sensor for sensing motion of the shoe;

a housing which houses the sensor;

at least one retaining member in contact with the housing; and an elastic member, distinct from the shoelace, releasably engaged with the at least one retaining member such that the elastic member is in a tensioned state and forms a part of a closed loop that encompasses at least one unknotted crossing of the shoelace, thereby securing the apparatus to the shoelace of the shoe.

27. The combination of claim 26, wherein the at least one retaining member is rigid.

28. The combination of claim 27, wherein the housing is rigid.

29. The combination of claim 26, wherein the housing is rigid.

30. The combination of claim 26, wherein the elastic member is releasably engaged with the at least one retaining member such that the elastic member directly contacts the at least one retaining member to form the closed loop.

31. The combination of claim 26, wherein the at least one retaining member is integrally formed with the housing.

32. The combination of claim 26, wherein the at least one retaining member is formed separately from the housing and is attached to the housing.

33. The combination of claim 32, wherein the at least one retaining member is non-releasably attached to the housing.

34. The combination of claim 26, wherein the closed loop encompasses at least two unknotted crossings of the shoelace.

35. The combination of claim 34, wherein the closed loop encompasses at least three unknotted crossings of the shoelace.

36. A method for securing a housing to a shoelace of a shoe, the method comprising steps of:

(a) providing the housing and an elastic member other than the shoelace of the shoe, the housing supporting a sensor for sensing motion of the shoe and having at least one retaining member in contact therewith; and (b) securing the housing to the shoelace by stretching the elastic member to selectively engage a first portion of the elastic member with the at least one retaining member, thereby forming a closed loop that includes at least a part of the elastic member and encompasses at least one unknotted crossing of the shoelace.

37. The method of claim 36, wherein:

the step (a) includes providing the housing such that the housing has at least one rigid retaining member supported thereby; and the step (b) includes releasably engaging at least the first portion of the elastic member with the at least one rigid retaining member.

38. The method of claim 37, wherein the step (a) includes providing the housing such that the housing is rigid.

39. The method of claim 36, wherein the step (b) includes releasably engaging at least the first portion of the elastic member with the at least one retaining member such that the elastic member directly contacts the at least one retaining member.

40. The method of claim 36, wherein the step (b) includes releasably engaging the first portion of the elastic member with the at least one retaining member so that tension remains in the elastic member when the closed loop is formed and the housing is secured to the shoelace.

41. The method of claim 36, further including a step of:

(c) attaching the at least one retaining member to the housing.

42. The method of claim 41, wherein the step (c) includes non-releasably attaching the at least one retaining member to the housing.

43. The method of claim 36, wherein the housing is secured to the shoelace so that the closed loop encompasses at least two unknotted crossings of the shoelace.

44. The method of claim 43, wherein the housing is secured to the shoelace so that the closed loop encompasses at least three unknotted crossings of the shoelace.

45. The method of claim 36, further comprising a step of:

(c) removing the housing from the shoelace without untying the shoelace.

* * * * *